US007425144B2

(12) United States Patent
Bader et al.

(10) Patent No.: US 7,425,144 B2
(45) Date of Patent: Sep. 16, 2008

(54) BUSS PLATE BUSHING RETAINER AND ASSEMBLY THEREOF

(76) Inventors: Scott M. Bader, 196 Maerwin Ave., Rochester, NY (US) 14609; Craig C. Bader, 890 Corwin Rd., Rochester, NY (US) 14610

( * ) Notice: Subject to any disclaimer, the term of this patent is extended or adjusted under 35 U.S.C. 154(b) by 3 days.

(21) Appl. No.: 11/670,828

(22) Filed: Feb. 2, 2007

(65) Prior Publication Data

US 2008/0188116 A1 Aug. 7, 2008

(51) Int. Cl.
*H01R 4/60* (2006.01)

(52) U.S. Cl. ..... 439/210; 439/212; 361/611; 361/624; 361/637

(58) Field of Classification Search ..... 439/210, 439/212, 213, 721; 361/611, 624, 637, 639, 361/648; 411/999, 546
See application file for complete search history.

(56) References Cited

U.S. PATENT DOCUMENTS 3,156,281 A * 11/1964 Demi ..... 411/147
3,995,675 A * 12/1976 Cosenza ..... 411/353
4,430,522 A 2/1984 Bader
4,802,863 A 2/1989 Debus
5,052,953 A 10/1991 Weber
5,206,461 A * 4/1993 Genzel et al. ..... 174/88 B
5,328,311 A * 7/1994 Knohl ..... 411/353
5,662,444 A * 9/1997 Schmidt, Jr. ..... 411/369
5,684,273 A 11/1997 Erdle et al.
5,711,711 A * 1/1998 Schmidt, Jr. ..... 470/41
5,941,654 A * 8/1999 Chauquet ..... 403/384
6,059,503 A * 5/2000 Johnson ..... 411/353
6,428,335 B1 8/2002 Bader et al.
6,456,485 B1 9/2002 Bader et al.
6,508,656 B2 1/2003 Chevassus-More et al.
6,705,886 B1 3/2004 Brown
6,945,801 B2 9/2005 Brown
2002/0009350 A1 * 1/2002 Radtke ..... 411/353
2006/0231285 A1 * 10/2006 Bisson et al. ..... 174/94 R
2006/0239798 A1 * 10/2006 Chantrel et al. ..... 411/546
2006/0264121 A1 11/2006 Camancho
2007/0093144 A1 4/2007 Charrier et al.

FOREIGN PATENT DOCUMENTS

WO WO2004030170 4/2004
WO WO2004084351 9/2004

* cited by examiner

*Primary Examiner*—Renee S Luebke
*Assistant Examiner*—Vanessa Girardi
(74) *Attorney, Agent, or Firm*—Duane C. Basch; Basch & Nickerson LLP

(57) ABSTRACT

A method and apparatus for the economical and reliable assembly of buss plates and components thereon, having a bushing positioned on one or more surfaces or therebetween. A novel spring-like retainer is employed to retain a plurality of bushings in proximity to a plurality of buss plate through holes to facilitate easy assembly. The use of the spring retainer eliminates the requirement for costly and potentially adverse pre-assembly soldering of the busing into position.

14 Claims, 4 Drawing Sheets

BUSS PLATE BUSHING RETAINER AND ASSEMBLY THEREOF

The present invention is directed to a mechanical and/or electrical interconnection device, in which a power distribution assembly (PDA), or circuit backplane, is formed having a plurality of conductive buss plates whereby the components and buss plates are fastened together having bushings therebetween, forming a laminated multilayer buss board assembly for conveying electric power or signals to, from and between various electronic components within a power distribution assembly. In one embodiment, a resilient split cylinder retainer or ferrule is inserted within a bushing and a buss plate hole or aperture so as to retain the bushing in alignment during the buss board and component assembly processes.

BACKGROUND AND SUMMARY OF THE INVENTION

In order to reduce the size, as well as increase efficiency of a power distribution assembly, conductive buss plates are employed having lateral direct interconnections to high current switching devices, thereby mitigating the traditional use of hard wiring and associated bulky cable harnesses. The buss plate is designed to be mounted to, and within, an enclosure whereby the components are then attached to the plate in such a manner as to complete the power supply circuit. Accordingly, buss plates lower the manufacturing costs by decreasing assembly time, as well as material costs. Furthermore, the flexibility of buss plates provide for a variety of form factors to accommodate obstacles inherent within the assembly, such as transformers, heat sinks, circuit breakers and the like.

Additionally, there are significant technical and functional advantages to the use of buss plates over hard wires. For example, a determining factor in mitigating electrical noise is to reduce circuit inductance while increasing the capacitance. Accordingly, the use of relatively thin parallel conductive buss plates, having a dielectric laminate as a substrate, has a tendency to minimize the effect of inductance by increasing the capacitance between electrical circuit planes. Laminated buss plates are important as well for the reduction of power circuit inductance to reduce transient voltages and to control parasitic oscillations when using high current insulated gate bi-polar transistor (IGBT) modules.

More specifically, it has been found that a PDA consisting of conductive buss plates, made from fabricated copper adhered onto a thin dielectric material and then sandwiched together to form a power buss circuit board, provides for both the mechanical mounting and electrical connectivity of components such as filter capacitors and semiconductor switching devices, for example IGBT's. The mechanical/electrical connection points or vias, are interposed between the conductive surfaces within the insulated buss plates. The components are secured with a fastener and a bushing or embossed conductive surface, the fastener passing through and contacting one or more of the plates and subsequently threading directly into a component. Notably, each connection through hole within the buss plate requires a copper bushing that is generally soldered into place, or alternatively an embossed surface, so as to be in direct alignment with the through hole. The copper bushing may be in the form of a flat-sided, washer-like component, and in one embodiment may also include a star-shaped locking washer to prevent problems with the backing-out or reversing of the fastener.

As mentioned, it is generally necessary to incorporate and retain a large bushing or washer around each connection through hole in the buss plate prior to assembly. However, the present practice requires the bushing to be pre-assembled to the buss plate by soldering, or welding the bushing to the buss plate about a hole in order to retain the bushing in position during the assembly operation. This requires a solder reflow, or similar process, to ensure that a plurality of connection points, have bushings therein, are simultaneously aligned for subsequent assembly. This soldering process is complex and in some cases has proven to be counterproductive and detrimental to providing a solid and reliable connection due to; (i) assembly alignment issues, (ii) thermal distortion introduced in the assembled components, (iii) compromised co-planarity, and (iv) increased softness of the bushing material. The soldering process also often results in corrosion due to the use of a fluxing agent, which interferes with a "hard" bushing to buss plate connection.

In order to solve the above-described problems, the present invention is directed to the assembly of a buss plate board connecting system comprising an electrically conductive buss plate having a plurality of through holes, a bushing disposed inline to a through hole having a hole therein coinciding with a hole in the buss plate and a compressible cylindrical retainer inserted within the hole of the bushing and the buss plate through hole so as to retain the bushing in general alignment with the buss plate through hole.

One object of the present invention is to provide an electromechanical inner connective means between buss plates and components that will overcome the above-described problems associated with pre-soldering the bushing in place by perpetually eliminating the bushing to buss plate soldering process with the use of a cylindrical spring bushing or retainer.

In accordance with a further aspect of the present invention, there is provided a compressible cylindrical retainer that mechanically retains the bushing in order to facilitate ease of assembly, whereby the bushing is permitted nominal movement to compensate for hole tolerances and offsets.

The assembly of the buss board structure, according to the present invention, can be greatly simplified by eliminating the necessity to align and solder the bushing onto the board prior to assembly. In effect, the bushing in the completed assembly is fundamentally secured to the buss board by the fastener and not the solder. Under the present process soldering of the bushing serves primarily as an interim means for the positioning of the bushing to assist in the assembly process, although in low-voltage applications the solder may assist with electrical conductivity. Once assembled there is little residual benefit and, in fact, soldering is all too often counterproductive and detrimental to a reliable connection due to the potential for; (i) misalignment, (ii) thermal distortion, (iii) corrosion and (iv) a weakened connection due to the metal fatigue from heating. Breaking or fracture of the soldered joints is even observed during the buss plane assembly process.

Additionally, by virtue of accumulated tolerances within the soldering process, the mechanical alignment of the bushing within the aperture of the first buss plate may not conform directly to the vertical axis of the mating buss plate or component because a bushing solder in place, unlike a cylindrical retainer, is incapable of yielding to compensate for coplanar alignment errors. As previously discussed the bushing must be in total contact in order to effectively conduct the high currents because contact surface area or diameter of the bushing is a function of the peak current capacity of the connection, expressed in circular mills. Consequently, one amp requires an area of approximately 400 circular mills of the bushing where a circular mill is defined as the square of the diameter of an equivalent round conductor expressed in units of $10^{-3}$ inches. Accordingly a skewed bushing will significantly decrease the contact area and therefore increase the connection resistance resulting in loss of power due to the generated heat. Therefore an objective in designing a high current power supply buss is to maintain low contact resistance by maximizing the contact surface area so as to provide only a nominal voltage drop and minimize the associated resistive heating effect in watts (W) at the connection point according to Ohm's Law where $R=V^2/W$ and $W=I^2\times R$.

The embodiment described and disclosed herein details aspects of the present invention in accordance with an interlocking cylindrical retainer/bushing assembly providing for an interim means to reliably locate the bushing onto the buss plate until a positive connection is established with a fastener passing through the buss plate and into an electrical component. The present invention therefore provides for significantly improved ease of assembly, improved reliability and reduced cost of manufacture. It is further contemplated that aspects of the disclosed embodiments permit the use of various and alternative materials, where the bushing is constructed of a material different from the buss plate and which may be plated or formed from a highly-conductive material.

In accordance with an embodiment disclosed herein, there is provided a buss plate connecting system comprising: an electrically conductive buss plate having a plurality of through holes; a bushing, disposed inline to a through hole within the buss plate having a hole therein said bushing coinciding with the through hole in the buss plate; and a circumferentially compressible cylindrical retainer inserted within the hole of the bushing and the through hole of the buss plate, to retain said bushing in general alignment with said buss plate through hole.

In accordance with another embodiment disclosed herein there is provided a buss plate connecting system having a first and second bushing, comprising: an electrically conductive buss plate having a plurality of through holes; a first and second bushing disposed inline to a through hole within the buss plate and having a hole therein said bushings coinciding with the hole in the buss plate; and a circumferentially compressible cylindrical retainer inserted within the hole of the first bushing, the buss plate through hole and the hole of the second bushing, to retain said bushings in general alignment with said buss plate through hole.

In accordance with a further embodiment disclosed herein there is provided a method of interconnecting a buss plate with a component comprising: placing at least one bushing in proximity to a through hole within a buss plate; compressing a cylindrical retainer, having a longitudinal slot, to reduce its diameter; inserting said retainer through a hole in the bushing and the buss plate through hole; and releasing the retainer thereby urging the bushing in alignment with said through hole in said buss plate.

BRIEF DESCRIPTION OF THE DRAWINGS

Other objects and features of the invention will become apparent to those skilled in the art as the disclosure is made in the following detailed description of a preferred embodiment of the invention as illustrated in the accompanying sheets of drawing, which are not necessarily drawn to scale, and in which.

DETAILED DESCRIPTION OF THE PREFERRED EMBODIMENTS

Figure 1:
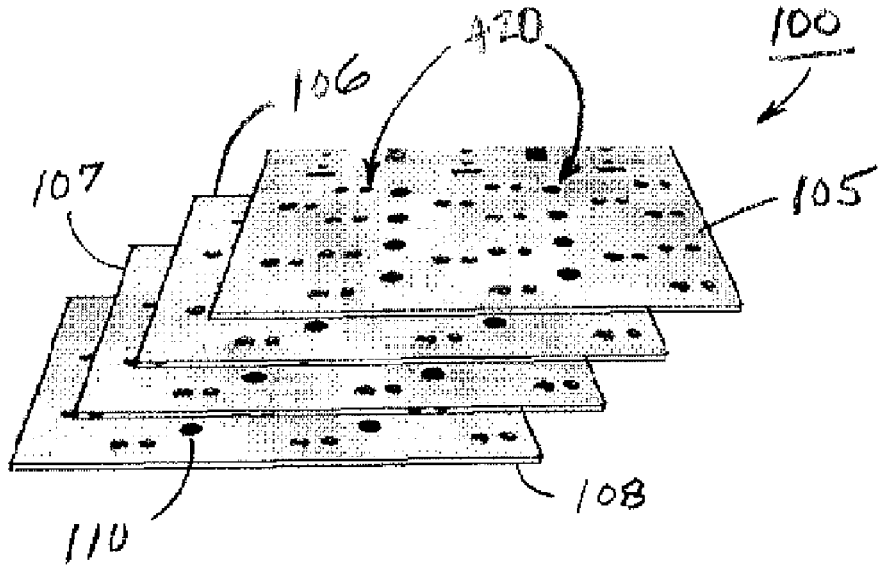
FIG. 1 is an exploded view of multiple buss plates within a buss board assembly.

For a general understanding of the present invention, reference is made to the drawings. In the drawings, like reference numerals have been used throughout to designate identical elements.

The disclosed embodiment(s) provides for the reliable union of a plurality of buss plates and components without the requirement for soldering the bushing in place. The bushing assembly is arranged in such a manner so as to secure one or more bushings in place with the insertion of a circumferentially compressed split cylinder retainer or ferrule or similar device having an interference fit within and between the inside diameter of the bushing and the hole within the buss plate. The split cylinder or ferrule is made from either a conductive or dielectric material containing resilient properties and having a longitudinal opening, or slit, to enable the pin to flex (e.g., compress) and therefore allow for the reduction of the inherent diameter for ease of insertion. In alternative embodiments, the split cylinder may be made from heat-treated stainless steel and copper alloys such as phos-bronze, beryllium copper, etc. In an alternative configuration it is contemplated that the split cylinder may be made from a wire-form embodied within plastic molded pieces.

Although generally depicted in a cylindrical shape, it is further contemplated that the retainer 320, described in detail below, may be non-cylindrical in its cross-sectional shape. For example, the retainer may have an elliptical or polygonal (e.g., hex-shaped) cross-section so as to prevent or reduce the rotation of the bushings relative to the plates. In other words, the retainer may also decrease the likelihood that the bushing may move—in any direction, including rotation.

The split cylinder further comprises a profile, including a flared rim, flange or formed ridge at each of the ends, whereby the first flared end interacts with a complementary chamfer, annular ring or groove fashioned around the open end of the hole on the opposite side of the buss plate. The second flared end of the split cylinder retainer engages, for example, an annular groove or recess about at least a portion of the internal diameter of the bushing hole. In one embodiment, the annular grove may be replaced by a coined rim, which may produce a continuous or regularly-spaced projection of the inner diameter for the bushing—thereby providing a feature on the bushing that positively engages with the flared end of the retainer.

This engaging feature of the spring cylinder, such as the flared end or formed ridge, "locks" the bushing in position and maintains alignment between the bushing and the buss plate hole. Once the first end flare of the retainer is seated in the buss plate hole chamfer and the second end engaged within the groove of the bushing hole, the bushing/spring assembly is in order to accept a fastener, which is then screwed into a component connection. Accordingly, the construction of the power distribution assembly is now accomplished by simply fastening the plates to the components and thereby providing a well aligned electrical and mechanical interconnect without the requirement for pre-soldering a bushing in place. Furthermore, because the alignment of the contact bushing is accomplished using the retainer, the need for embossing or other pre-working of the conductive plates is reduced—leading to less distortion and fewer processing steps in the assembly process.

Figure 2:
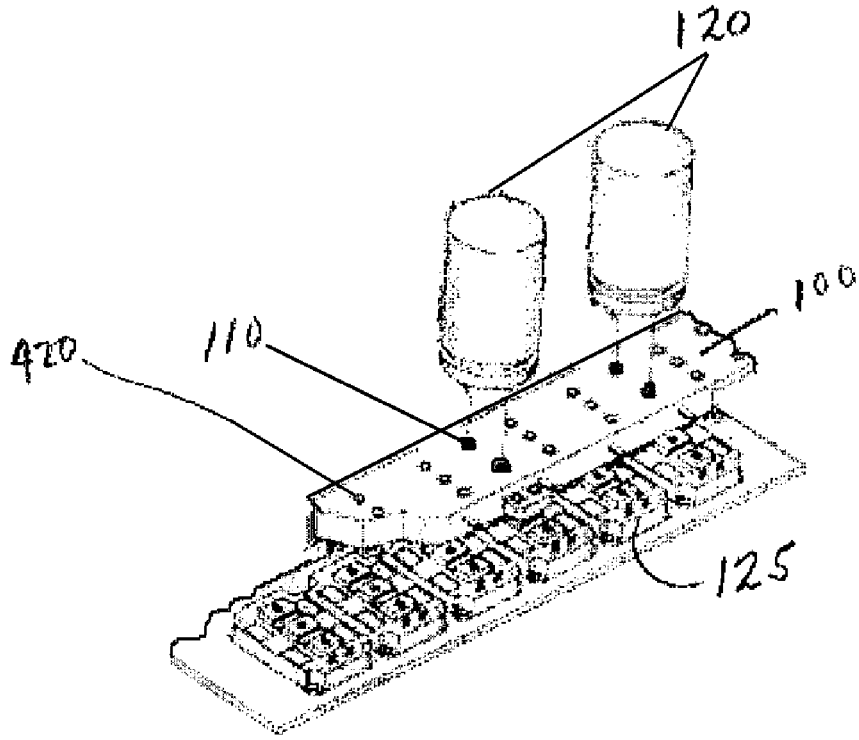
FIG. 2 is an exploded view of a power distribution assembly (PDA)

Referring to FIGS. 1 and 2, an exemplary buss board assembly 100 constitutes a first electric power input circuit buss plate 105 and a second electric power input circuit buss plate 106 that connects a plurality of devices 125 (e.g., IGBTs) and capacitors 120 therebetween and first electric power output circuit buss 107 and second electric power output circuit buss 108 also connecting a plurality of devices 125 and capacitors 120, as seen in FIG. 2. Located in direct proximity of each connection hole 420 within the buss plates is surface bearing bushing 110 that provides a high current electrical connection between buss board assembly 100 and the components, such as capacitor 120 and switch 125. Conductive bushing 110 is an essential element in providing a sufficiently large connection surface bearing area that has the ability to physically contact a mating surface to provide a solid electrical connection with a minimum voltage drop. The conductive bushing may also be in the form of a flat-sided, washer-like component, and in one embodiment may also include a star-shaped locking washer, or similar features, to prevent problems with the backing-out or reversing of the fastener.

Figure 3:
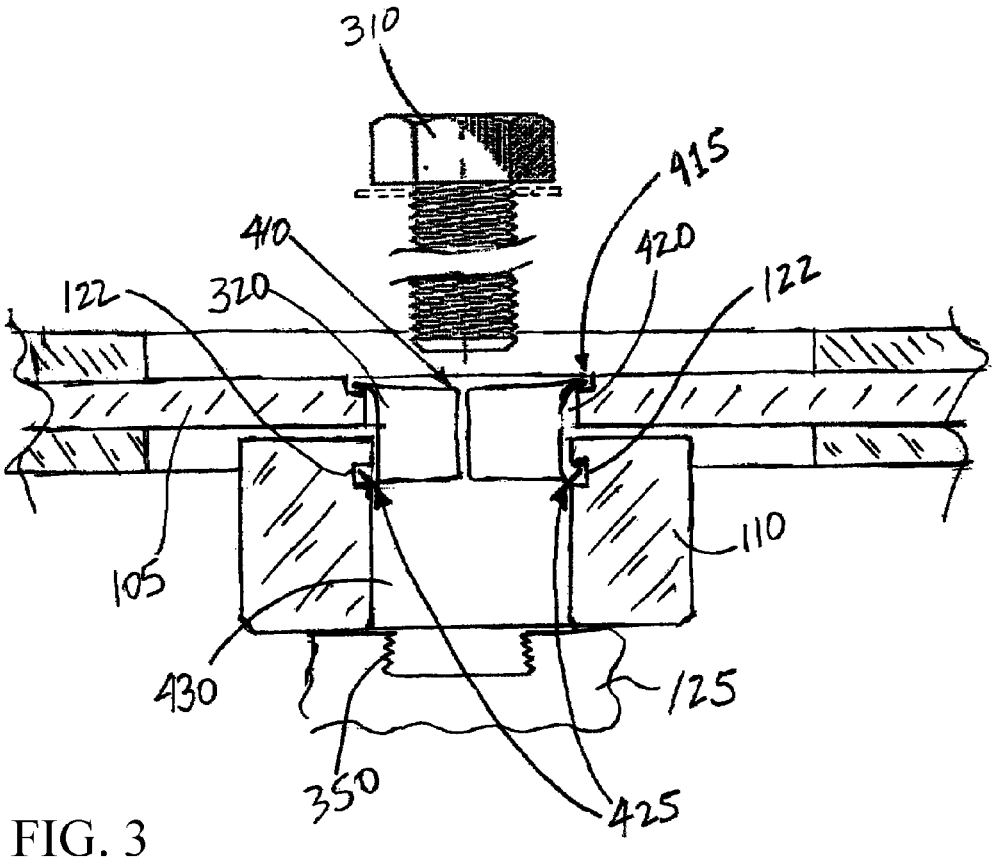
FIG. 3 is cut-away view of an exemplary buss assembly.
Figure 4:
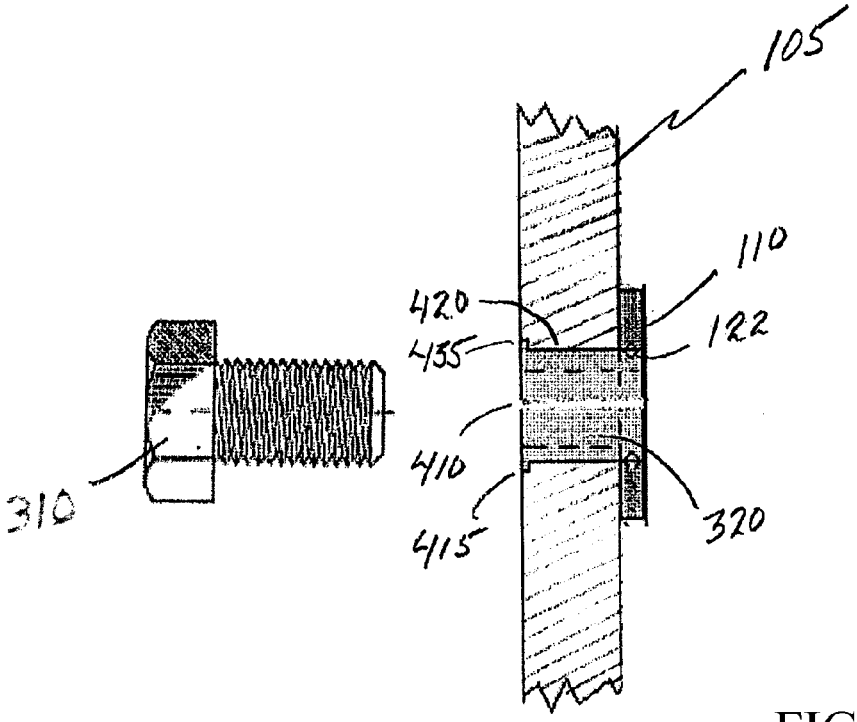
FIG. 4 is a planar cross-section view of the bushing assembly.

One aspect of the present invention deals with the basic problem of reliably locating bushing 110 in proximity to hole 420 without necessitating the step of first soldering bushing 110 into position as a pre-assembly requirement. In order to maintain bushing 110 in position for assembly, cylindrical retainer 320 is compressed and inserted through bushing 110 and subsequently pressed into hole 420 within buss plate 105, as depicted in FIG. 3. Once cylindrical retainer 320 is decompressed, buss plate hole 420 and bushing hole 430 provide a reactive force to the tension exerted from retainer 320, thereby creating a contact or friction fit, as well as a positive interlock developed between the incorporation of anterior flare 425 within groove 122 (also see FIG. 5). The retainer 320 thereby assures alignment of the conductive bushing 110 with the buss plate 105. Furthermore, retainer 320 assures that a connector 310 can be easily and reliably inserted therethrough in order to complete the electrical connection between the buss plate 105, bushing 110, and a device or component 125 (e.g., a threaded hole 350 or nut in the device).

Figure 5:
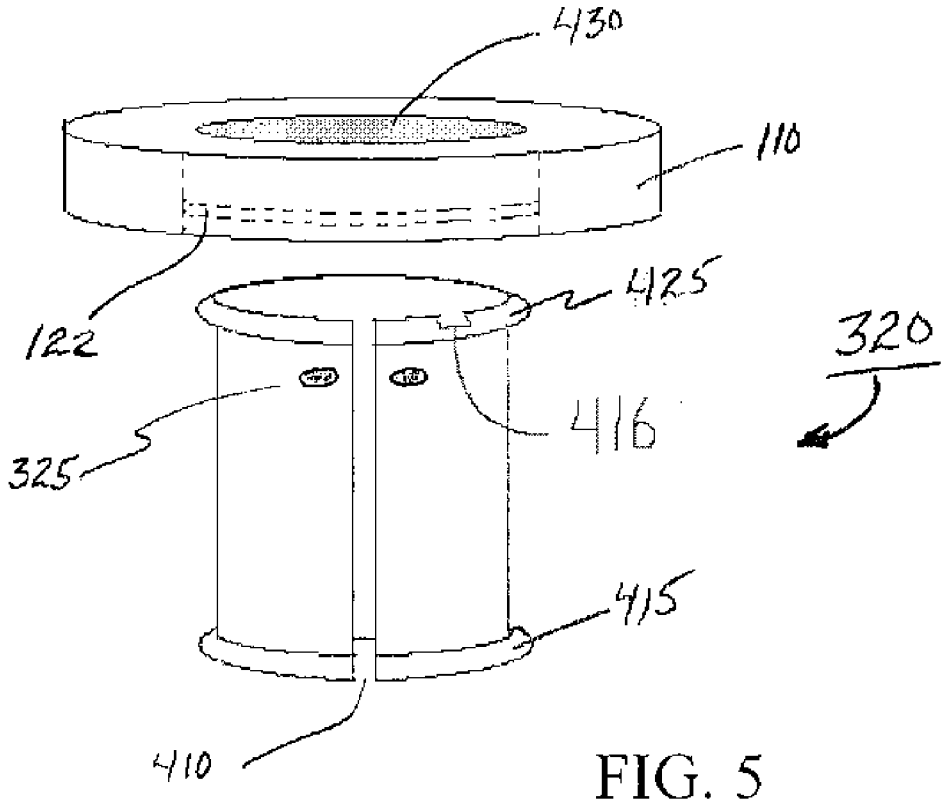
FIG. 5 is a isometric exploded view of the bushing and spring retainer.

Now referring to FIG. 5, cylindrical retainer 320 may be constructed from a conductive material having a high spring constant or resiliency, such as tempered high carbon steel, stainless steel and possibly alternative materials such as copper-berrylium, phos. bronze or other materials that exhibit spring-like resiliency. Non-conductive materials may also be used for retainer 320 such as polymers and reinforced carbon or fiberglass having the required elasticity without demonstrating evidence of a permanent deformation. Moreover, some materials may be composites that exhibit high resistance to heat, provide some level of conductivity, etc.

The tubular profile of cylindrical retainer 320 contains a number of distinctive features, one of which is a flare located about each of the open ends of the cylindrical retainer. Posterior flare 415 rests within bevel 435 of buss plate hole 420 so as to limit retainer 320 from pulling directly through hole 420. On the other hand anterior flare 425 engages groove or annular recess 122 within the annular diameter of hole 430 in bushing 110. Additionally, installation apertures 325 allow for the engagement of a compression tool (not shown) to facilitate the insertion of retainer 320 within buss plate 105. And lastly, a longitudinal slit 410, or opening, allows for clearance during the reduction in diameter when retainer 320 is compressed.

Also depicted in FIG. 5 is an illustrative representation of a detent or notch 416 or similar removal means for permitting a tool to interact with the lead edge of the cylindrical retainer 320, whereby the retainer 320 may be unseated or removed from a hole 430 or similar orifice into which it had been inserted. Removal means may be included at one or more locations around the periphery of the retainer 320, and may be at or near the longitudinal slit 410 to facilitate disengagement or the removal of the anterior flare from the annular recess 122.

Figure 6:
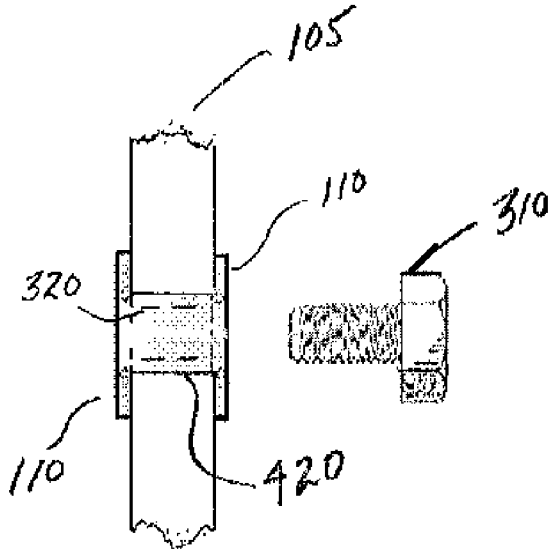
FIG. 6 is a fragmentary cross sectional view of a bushing buss connection.

Referring next to FIG. 6, there is shown an embodiment of retainer 320 used in conjunction with two or more bushings 110 and at least one buss plate 105. In this configuration anterior flare 425 snaps into the first bushing 110 while posterior flare 415 snaps into second bushing 110 having one or more buss plates therebetween. In this configuration, the bushings 110 are each held in place and permit the subsequent insertion of threaded members or other fastening means, such as bolt 310, therethrough to enable the make-up and joining of components using the buss plates.

As will be appreciated, particularly from the illustrations in FIGS. 3-6, one embodiment contemplates a method of interconnecting a buss plate with a component. The method includes placing at least one bushing 110 in proximity to a through hole 420 within a buss plate 105, compressing the cylindrically-shaped retainer 320, to reduce its diameter, inserting the retainer through a hole 430 in the bushing and the buss plate through hole 420, and then releasing the retainer 320. The release of the spring-like retainer allows it to return to a nominal state where it urges the bushing to remain in alignment with the through hole in the buss plate.

Figure 7:
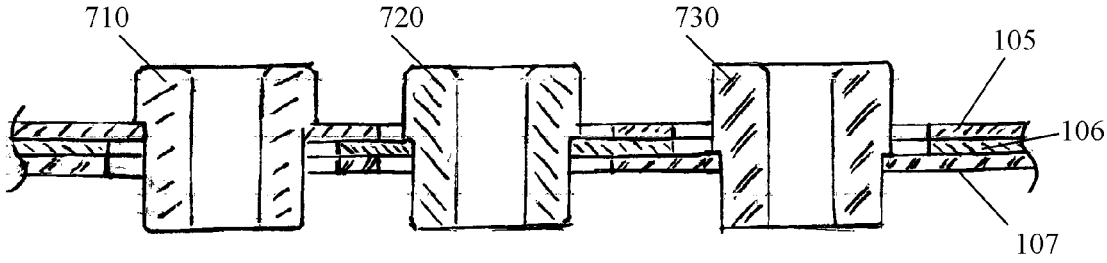
FIGS. 7 and 8 are illustrative cross-sections of various embodiments of known bushings and the current invention, respectively.
Figure 8:
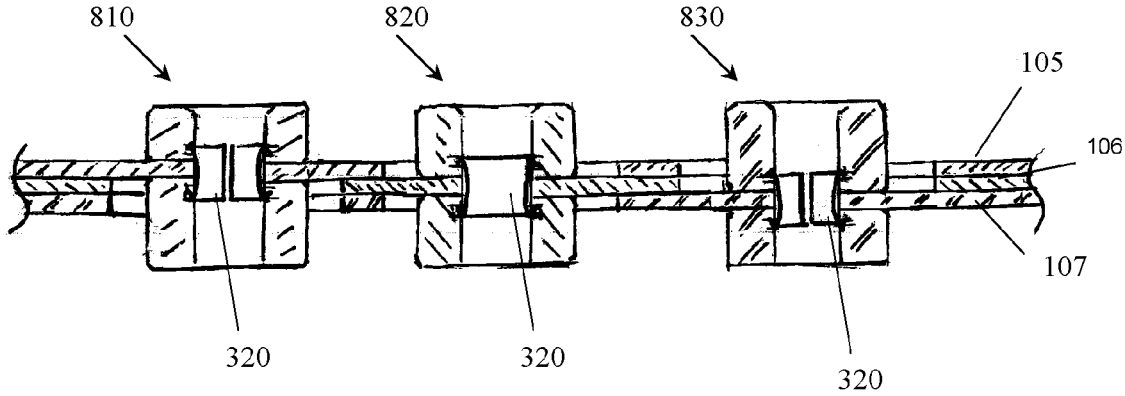

As a further illustration of several advantages of the embodiments disclosed herein, reference is made to FIGS. 7 and 8. In FIG. 7, there are depicted conventional connections 710, 720 and 730 relative to the various buss plates 105, 106 and 107. As illustrated, the connections 710, 720 and 730 include a shoulder 750, and a wall thickness suitable to produce the shoulder and to provide a portion 752 that extends through an aperture 420 in the buss plate. Compared with FIG. 8, where the connector assemblies 810, 820 and 830 include upper and lower connection bushings joined by the compressible retainer 320, it is apparent that the embodiments of FIG. 8 provide greater contact with the buss plate, and result in greater ease of assembly of the buss plate, where there is improved ability to align the resulting connectors.

In recapitulation, the present invention is a method and apparatus for the expeditious and reliable assembly of buss plates and components thereon, by eliminating the operation of soldering a bushing in place. A unique cylindrical retainer has been discovered that serves to retain the bushing in a desired position in order to facilitate ease of assembly. While this invention has been described in conjunction with preferred embodiments thereof, it is evident that many alternatives, modifications, and variations will be apparent to those skilled in the art. Accordingly, it is intended to embrace all such alternatives, modifications and variations that fall within the spirit and broad scope of the appended claims.

What is claimed is:

1. A buss plate connecting system comprising:

an electrically conductive buss plate including a planar surface and a plurality of through holes;

a bushing including a first surface in contact with the planar buss plate surface, a second surface opposite the first surface the bushing including an axial hole therethrough wherein said bushing does not extend into any through hole of the buss plate, the axial through hole having a length defined as the distance between the first surface and the second surface; and a retainer having one portion inserted into a buss plate through hole, and a second portion inserted within and contacting the axial hole of the bushing such that the second portion of the retainer does not extend beyond the length of the axial hole, said retainer retaining said bushing in general alignment with said buss plate through hole to thereby permit a connector to be inserted through the bushing and buss plate.

2. The buss plate connecting system of claim 1, wherein said retainer is flared outwardly about at least a portion of one end of said retainer.

3. The buss plate connecting system of claim 1 wherein the buss plate through hole further includes a chamfer about an opening of the through hole.

4. The buss plate connecting system of claim 1 wherein the retainer is compressible and includes a flared end, and where the bushing further comprises an internal annular groove about an axis of the bushing hole to engage the flared end of the compressible retainer.

5. The buss plate connecting system of claim 1, wherein said retainer is circumferentially compressible and further includes a longitudinal slit to increase the compressability of said retainer.

6. The buss plate connecting system of claim 5 further comprising a feature for the engagement of a tool to reduce the diameter of the retainer during insertion.

7. A buss plate connector, comprising:

a circumferentially compressible retainer for retaining a bushing on a surface of a buss plate, said bushing further comprising an axial hole defining a length through the bushing;

wherein a first portion of said retainer is inserted within one end of the axial hole of the bushing and a second portion of the retainer is inserted into a buss plate through hole, wherein said retainer retains and substantially aligns the bushing with the buss plate through hole without the first portion of the retainer extending beyond the length of the axial hole in the bushing.

8. The buss plate connector of claim 7, wherein said compressible retainer further contains a longitudinal slit to permit compression thereof during insertion of the retainer into the through hole and bushing.

9. The buss plate connector of claim 7, wherein said compressible retainer further includes, adjacent at least one end thereof, a portion that is flared outward to engage an inner surface of the bushing.

10. The buss plate connector of claim 8 further comprising an aperture on opposite sides of said longitudinal slit for the engagement of tooling to reduce the diameter of the retainer during insertion or removal.

11. The buss plate connector of claim 9, wherein the bushing further includes an internal annular groove about the bushing hole wherein the annular groove of the bushing engages the portion of the retainer that is flared so as to provide a positive engagement between the retainer and the bushing.

12. A method of electrically interconnecting a, generally planar portion of a buss plate with a component, comprising:

placing at least one bushing including an axial hole defining a length therethrough on one side of the planar portion and in proximity to a through hole in the buss plate;

compressing a retainer, having a longitudinal slot, to reduce its diameter;

inserting a first portion of said retainer into an end of the axial hole in the bushing and a second portion of the retainer into the buss plate through hole, such that the first portion of the retainer does not extend the length of the axial hole in the bushing and remains below a contact surface of the bushing to permit direct electrical contact between the bushing and component; and releasing the retainer to engage an inner surface of the bushing hole and thereby urging the bushing into, general alignment with said through hole in said buss plate.

13. The method of claim 12 wherein the bushing includes an annular grove on the inner surface of the bushing hole, further comprising engaging the annular groove with the retainer.

14. The method of claim 12, further including inserting a connecting member associated with a component through the center of the retainer, and thereby the bushing and the buss plate, to provide a connection of the component to the buss plate.

* * * * *